US007059546B2

(12) United States Patent
Ogata et al.

(10) Patent No.: US 7,059,546 B2
(45) Date of Patent: Jun. 13, 2006

(54) AEROSOL SPRAY NOZZLE

(75) Inventors: Ken Ogata, Saitama (JP); Kazunori Hoshino, Zushi (JP)

(73) Assignee: Toyo Aerosol Industry Co., Ltd., Tokyo (JP)

( * ) Notice: Subject to any disclaimer, the term of this patent is extended or adjusted under 35 U.S.C. 154(b) by 17 days.

(21) Appl. No.: 10/450,328

(22) PCT Filed: Oct. 15, 2002

(86) PCT No.: PCT/JP02/10672

§ 371 (c)(1),
(2), (4) Date: Jul. 22, 2003

(87) PCT Pub. No.: WO03/033166

PCT Pub. Date: Apr. 24, 2003

(65) Prior Publication Data

US 2004/0050956 A1 Mar. 18, 2004

(30) Foreign Application Priority Data

Oct. 16, 2001 (JP) ..... 2001-318627
Sep. 12, 2002 (JP) ..... 2002-267204

(51) Int. Cl.

| | |
|---|---|
| ***B05B 1/26*** | (2006.01) |
| ***B05B 1/34*** | (2006.01) |
| ***B05B 7/30*** | (2006.01) |
| ***E03C 1/08*** | (2006.01) |
| ***B67D 5/58*** | (2006.01) |

(52) U.S. Cl. ..... 239/461; 239/343; 239/428.5; 239/468; 239/499; 239/524; 222/190

(58) Field of Classification Search ..... 239/461, 239/343, 428.5, 468, 499, 524, 337, 418, 239/425.5, 462, 463, 467, 469, 470, 476, 239/504, 518, 520; 222/190, 402.1, 547, 222/564

See application file for complete search history.

(56) References Cited

U.S. PATENT DOCUMENTS 4,350,298 A * 9/1982 Tada ..... 239/333
5,611,490 A 3/1997 Barriac et al.

FOREIGN PATENT DOCUMENTS

| | | |
|---|---|---|
| EP | 718041 | 6/1996 |
| JP | 53468/1992 | 5/1992 |
| JP | 8-229463 | 9/1996 |
| JP | 2002-66388 | 3/2002 |

* cited by examiner

*Primary Examiner*—David A. Scherbel
*Assistant Examiner*—Darren Gorman
(74) *Attorney, Agent, or Firm*—Jordan and Hamburg LLP

(57) ABSTRACT

It is an object of the invention to provide an injection nozzle that efficiently foams foamed aerosol content, thereby improving adhering ability onto applying part. Furthermore, facilitating the oxidization of the foamed aerosol content and improving the effectiveness of the foamed aerosol content. It is also an object of the invention to provide an aerosol injection nozzle for injecting the foamed aerosol content that the clogging is prevented even when the foamed aerosol content have a high viscosity with a simple constitution and in low cost. An aerosol injection nozzle according to the invention includes a collision wall for foamed aerosol content to be collided and interfusing with air, disposed at an injection outlets. The collision wall is disposed within a retention chamber for temporary retaining the foamed aerosol content. The aerosol injection nozzle includes an outflowing outlet for outflowing the foamed aerosol content at least at a lower side of an injection axis line between retention chamber and injection outlets.

6 Claims, 10 Drawing Sheets

AEROSOL SPRAY NOZZLE

BACKGROUND OF THE INVENTION

The present invention relates to an aerosol injection nozzle used upon foaming by interfusing air for injecting foamed aerosol content such as body supplies such as, e.g., hair supplies, cosmetic preparations, deodorants and anti-perspirants, insecticides, cleaning supplies, industrial materials, car supplies and food products and, more particularly, to an aerosol injection nozzle used advantageously for foamed aerosol content having a high viscosity.

Conventionally, there is an aerosol injection nozzle such disclosed in JP-A-8-229463 that foaming and oxidizing an foamed aerosol content by interfusing with air immediately prior to use the foamed aerosol content. The conventional aerosol injection nozzle has a mesh screen disposed at an injection outlet of the foamed aerosol content. The conventional aerosol injection nozzle fractures the foamed aerosol content when injected outward from the injection outlet and passed through fine openings of the mesh screen, and interfuses with air, thereby producing the foaming.

However, in order to acquire a favorable foaming in the conventional technology, troublesome assembling and highly skills in controlling the size of the minute openings of the mesh screen are required and complicated constitution of the injection nozzle is needed. In addition, in the conventional technology, because a residual easily remains on the mesh screen, the residual tends to dry out, and dusts tends to adhere to the residual. Therefore, clogging may occur to the minute openings of the mesh screen, and the aerosol device becomes inefficient to favorably injecting the foamed aerosol content. The occurrence of the clogging becomes more frequent when the foamed aerosol content has a high viscosity.

BRIEF SUMMARY OF THE INVENTION

It is therefore an object of the invention to overcome the aforementioned problems by efficiently interfusing foamed aerosol content with air and improve a foaming effect of the foamed aerosol content, thereby improving adhering ability and usability of the foamed aerosol content. Furthermore, by improving the interfusion of the foamed aerosol content and air and facilitating the oxidization of the foamed aerosol content that effectively works when oxidized, it is an object of this invention to improve the effectiveness of the foamed aerosol content. It is also an object of the invention to provide an aerosol injection nozzle for injecting the foamed aerosol content that clogging is prevented even when the foamed aerosol content have a high viscosity with a simple constitution and in low cost.

In order to achieve the object, according to a first aspect of the invention, there is provided an aerosol injection nozzle including: a collision wall for foamed aerosol content to be collided and interfusing with air, disposed at an injection outlet for foamed aerosol content; and an outflowing outlet for outflowing the foamed aerosol content foamed upon collision to the collision wall, connected to the collision wall and disposed at a lower side of the collision wall.

In order to achieve the object, according to a second aspect of the invention, there is provided an aerosol injection nozzle including: a retention chamber for temporary retaining foamed aerosol content in a foamed state; a collision wall for foamed aerosol content to be collided and interfusing with air, disposed at an injection outlet for foamed aerosol content and within the retention chamber; and outflowing outlet for outflowing the foamed aerosol content foamed by colliding to the collision wall, disposed at a lower side of an injection axis line between the retention chamber and the injection outlet.

The collision wall may be connected to a push button connected to a stem of an aerosol container via a bridge member having a rectangular letter U shape and having openings at upper and lower side surfaces, wherein the outflowing outlet is formed as an opening formed at a lower side surface of the bridge member.

The collision wall may be connected to a push button connected to a stem of an aerosol container via a bridge member having an L-lettered shape and having openings at upper and lower side surfaces, wherein the outflowing outlet is formed as an opening formed at a lower side surface of the bridge member.

Also, forming one or more of the injection outlets disposed toward the collision wall may be preferable.

The collision wall may be formed in a concaved conical shape in a direction corresponding to the injection axis line of the foamed aerosol content injecting from the injection outlet.

The collision wall may be formed in a protruded conical shape in a direction corresponding to the injection axis line of the foamed aerosol content injecting from the injection outlet.

The collision wall may be formed in a concaved C-lettered shape in a direction corresponding to the injection axis line of the foamed aerosol content injecting from the injection outlet.

The collision wall may be formed to have a plurality of protrusions at given intervals.

In order to achieve the object, according to a third aspect of the invention, there is provided an aerosol injection nozzle including: a ring shaped flow passage for foamed aerosol content to be collided and interfusing with air, disposed at an injection outlet for the foamed aerosol content; and an injection axis line of the foamed aerosol content, disposed in direction tangent to the ring shaped flow passage, wherein colliding the foamed aerosol content injected from the injection outlet into a collision wall inside the ring shaped flow passage and interfusing the foamed aerosol content with air to be foamed by rotating at least for a 360-degree within the ring shaped flow passage, wherein outflowing the foamed aerosol content foamed from an outflowing outlet disposed at lower surface of the ring shaped flow passage.

The ring shaped flow passage may be connected to a push button connected to a stem of an aerosol container via a bridge member having a rectangular letter U shape and having openings at upper and lower side surfaces, wherein the outflowing outlet is formed as an opening formed at a lower side surface of the bridge member.

The ring shaped flow passage may be connected to a push button connected to a stem of an aerosol container via a bridge member having an L-lettered shape and having openings at upper and lower side surfaces, wherein the outflowing outlet is formed as an opening formed at a lower side surface of the bridge member.

Also, forming one or more of the injection outlet disposed toward the collision wall may be preferable.

According to the first aspect of the invention, when injecting and applying the foamed aerosol content onto an applying target, injecting the foamed aerosol content contained within an aerosol container from the injection outlet by operating an appropriate push button or an actuator provided with the aerosol injection nozzle of the invention, and strongly colliding the injected foamed aerosol content onto the collision wall, thereby the foamed aerosol content interfuses with air and become in a foamed state. The foamed aerosol content foamed as above is collided onto the collision wall and outflowed from the outflowing outlet, which is connected to the collision wall and disposed at a lower side of the collision wall, by gravitation. The outflowed foamed aerosol content in foamed state is applied onto the target portion either directly or via an appropriate medium such as a human hand, a comb or a brush.

As described above, the aerosol injection nozzle positively interfuses the foamed aerosol content with air and efficiently causes the foaming, the adhering ability of the foamed aerosol content onto the applying target improves, and can smoothly apply the foamed aerosol content onto the applying target by preventing the trickling of the content or shattering into the air. Also, the flow passage of the foamed aerosol content may be disposed at the lower surface of the collision wall. Therefore, the diameter of the flow passage can be enlarged, and the foamed aerosol content can be outflowed therefrom spontaneously by gravitation even when the foamed aerosol content has high viscosity.

In the conventional aerosol injection nozzle, a residual easily remains on the mesh screen, and that dust tends to adhere to the dried out residual, and a clogging occurs to the minute openings of the mesh screen, specifically when the foamed aerosol content have a high viscosity. In contrast, in present invention, such minute openings are not included, and the diameter of the flow passage can be enlarged, so that the foamed aerosol content in a foamed state can be easily outflowed. Therefore, when the foamed aerosol or a dust adheres to the flow passage, the injection outlet will not be clogged, and can maintain the efficient outflow of the foamed aerosol content. Furthermore, in the invention, there is no need to attach an additional member for foaming the aerosol such as a mesh screen, the aerosol injection nozzle can be manufactured in a simple constitution and in a low cost.

In addition, a foamed aerosol content that works by oxidizing such as an oxidizing hair dye, is interfused with air intensively at the collision wall and the efficiently oxidized, so that the effectiveness can be improved. Moreover, by not containing the foamed aerosol content in the aerosol container in a pre-oxidized state, and by oxidizing the foamed aerosol content by interfusing with air just before the use thereof, the quality of the foamed aerosol content can be preserved, and can be used in a very efficacious state.

According to the second aspect of the invention, when injecting and applying the foamed aerosol content onto an applying target, injecting the foamed aerosol content contained within an aerosol container from the injection outlet by operating an appropriate push button or an actuator provided with the aerosol injection nozzle of the invention and pressing the stem. Pressing of the stem causes a valve mechanism to be opened, and the foamed aerosol content within the aerosol container outflows via the stem and injects from the injection outlet into the retention chamber.

The foamed aerosol content injected from the injection outlet strongly collides onto the collision wall, and bounce back in direction to the injection outlet, thereby flowing actively while retaining within the retention chamber. The flowing causes the foamed aerosol content to interfuse with air and the foamed aerosol content become in a foamed state. The foamed aerosol content foamed as above outflows from the outflowing outlet. The outflowed foamed aerosol content in foamed state is applied onto the target portion either directly or via an appropriate medium such as a human hand, a comb or a brush.

As described above, the aerosol injection nozzle positively interfuses the foamed aerosol content with air and efficiently causes the foaming, the adhering ability of the foamed aerosol content onto the applying target improves, and can smoothly apply the foamed aerosol content onto the applying target by preventing the trickling of the content or shattering into the air. Also, the flow passage of the foamed aerosol content is disposed at the lower surface of the collision wall. Therefore, the foamed aerosol content can be outflowed therefrom spontaneously by gravitation even when the foamed aerosol content has high viscosity. Moreover, in contrast to the constitution disposing the outflowing outlet in direction corresponding to the injection direction of the foamed aerosol content or disposing the outflowing outlet in the vicinity of the injection direction, the diameter of the outflowing outlet can be enlarged, and the foamed aerosol content can be outflowed therefrom spontaneously by gravitation even when the foamed aerosol content has high viscosity.

In the conventional aerosol injection nozzle, a residual easily remains on the mesh screen, and dusts tend to adhere to the dried out residual, and clogging occurs to the minute openings of the mesh screen, specifically when the foamed aerosol content have a high viscosity. In contrast, in present invention, such minute openings are not included, and the foamed aerosol content outflows spontaneously by the weight thereof from the outflowing outlet having a large diameter. Therefore, when the foamed aerosol or dusts adhere to the outflowing outlet, the injection outlet will not be clogged, and can maintain the efficient outflow of the foamed aerosol content. Furthermore, in the invention, there is no need to attach an additional member for foaming the aerosol such as a mesh screen, so that the aerosol injection nozzle can be manufactured in a simple constitution and in low costs.

In addition, a foamed aerosol content that works by oxidizing such as an oxidizing hair dye, is interfused with air intensively when retaining within the retention chamber, so that the foamed aerosol content becomes efficiently oxidized, and thereby the effectiveness can be improved. Moreover, by not containing the foamed aerosol content in the aerosol container in a pre-oxidized state, and by oxidizing the foamed aerosol content by interfusing with air immediately before the use thereof, the quality of the foamed aerosol content can be preserved, and can be used in a very efficacious state.

The retention chamber is connected to an exterior via flow passage, and therefore, air is filled therein. Therefore, the foamed aerosol content can be efficiently interfused with air and the foaming and oxidizing thereof can be attained even when the injection outlet is formed without any opening to introduce air therein except for the flow passage.

The collision wall may be connected to a push button connected to a stem of an aerosol container via a bridge member having a rectangular letter U shape and having openings at upper and lower side surfaces, wherein the outflowing outlet is formed as an opening formed at a lower side surface of the bridge member. According to the configuration, the outflowing outlet can be enlarged and the foamed aerosol content having a high viscosity can be outflowed effectively.

The bridge member may be formed in an L-lettered shape and not in a rectangular letter U shape. According to the configuration, in contrast to forming the bridge member in a rectangular letter U shape, the shape of the bridge member can be simplified and lower the cost of the product. However, the configuration lowers the mechanical strength of the bridge member than that formed in a rectangular letter U shape.

Also, forming one or more of the injection outlet disposed towards the collision wall may be preferable. When one injection outlet is disposed, the product can be easily manufactured, and the manufacturing cost of a metal mold can be reduced than that for a product having a plurality of injection outlets. By contrast, when a plurality of injection outlets is disposed, the manufacturing cost of a metal mold becomes expensive, but the efficiency of the interfusion can be improved than injecting from one injection outlet, and efficiency of oxidization and foaming of the foamed aerosol content can be improved.

The collision wall that the foamed aerosol content is to be collided may be formed in a concaved conical shape in direction correspondent to the injection axis line of the foamed aerosol content injecting from the injection outlet. According to the configuration, the particles of the foamed aerosol content that collided into the collision wall bounce back in immethodical direction and diffuse widely within the retention chamber, and thereby the interfusion and agitating with air can be improved, as well as efficient foaming that contains plentiful air bubbles can be attained.

The collision wall may be formed in a protruded conical shape in direction correspondent to the injection axis line of the foamed aerosol content injecting from the injection outlet. According to the configuration, the foamed aerosol content collided to the collision wall rotates around the periphery of the protruded conical shape forming a vortex, and diffuses widely, thereby the time length retaining within the retention chamber becomes long and efficient interfusion with air and improved foaming efficiency can be attained.

The collision wall may be formed in a concaved C-lettered shape in direction correspondent to the injection axis line of the foamed aerosol content injecting from the injection outlet. According to the configuration, convection occurs within the concaved C-lettered shape to the foamed aerosol content collided to the collision wall, thereby the time length retaining within the retention chamber becomes long. Furthermore, the convection of the foamed aerosol content collides to the following injected foamed aerosol content, thereby the efficient interfusion with air and improved foaming efficiency can be attained. In addition, when forming the collision wall in a concaved C-lettered shape, it is possible to form only the collision wall in a concaved C-lettered shape, but it is also possible to form the collision wall in a concaved C-lettered shape in a manner integrated with the retention chamber.

The collision wall may be formed to have a plurality of protrusions at given intervals. According to the configuration, the foamed aerosol content collided into the collision wall collides to the following injected foamed aerosol content, thereby the time period retaining within the retention chamber can be made longer and efficient interfusion with air and improved foaming efficiency can be attained.

According to the third aspect of the invention, when injecting and applying the foamed aerosol content onto an applying target, injecting the foamed aerosol content contained within an aerosol container from the injection outlet by operating an appropriate push button or an actuator provided with the aerosol injection nozzle of the invention and pressing the stem. The pressing of the stem causes a valve mechanism to be opened, and the foamed aerosol content within the aerosol container outflows via the stem and injects from the injection outlet into the flow passage.

The foamed aerosol content injected from the injection outlet strongly collides onto the collision wall formed inside the flow passage, and flows at a high speed within the ring shaped flow passage. The flowing is prosecuted at least for a 360-degree, and causes the foamed aerosol content to interfuse with air in flowing process. Normally, the rotating flow is prosecuted for a plurality of times, and the rotating foamed aerosol content collides to the following formed aerosol content continuously jet injected from the injection outlet into the flow passage, and the interfusion with air becomes more efficient, thereby the plentiful of foaming can be attained. The foamed aerosol content foamed as above outflows from the outflowing outlet. The outflowed foamed aerosol content in foamed state is applied onto the target portion either directly or via an appropriate medium such as a human hand, a comb or a brush.

As described above, the aerosol injection nozzle positively interfuses the foamed aerosol content with air and efficiently causes the foaming, the adhering ability of the foamed aerosol content onto the applying target improves, and can smoothly apply the foamed aerosol content onto the applying target by preventing the trickling of the content or shattering into the air. Also, the flow passage of the foamed aerosol content is disposed at the lower surface of the collision wall. Therefore, the foamed aerosol content can be outflowed therefrom spontaneously by gravitation even when the foamed aerosol content has a high viscosity. Moreover, in contrast to the constitution disposing the outflowing outlet in direction corresponding to the injection direction of the foamed aerosol content or disposing the outflowing outlet in the vicinity of the injection direction, the diameter of the outflowing outlet can be enlarged, and the foamed aerosol content can be outflowed therefrom spontaneously by gravitation even when the foamed aerosol content has a high viscosity.

In the conventional aerosol injection nozzle, a residual easily remains on the mesh screen, and that dust tends to adhere to the dried out residual, and a clogging occurs to the minute openings of the mesh screen, specifically when the foamed aerosol content has a high viscosity. In contrast, in present invention, such minute openings are not included, and the foamed aerosol content outflows spontaneously by the weight thereof from the outflowing outlet having a large diameter. Therefore, when the foamed aerosol or dusts adhere to the outflowing outlet, the injection outlet will not be clogged, and can maintain the efficient outflow of the foamed aerosol content. Furthermore, in the invention, there is no need to attach an additional member for foaming the aerosol such as a mesh screen, so that the aerosol injection nozzle can be manufactured in a simple constitution and in low costs.

In addition, a foamed aerosol content that works by oxidizing such as an oxidizing hairdye, is interfused with air intensively when the flowing is prosecuted within the ring shaped flow passage at least a 360-degree, normally prosecuted for a plurality of times, after colliding to the collision wall, and the rotating foamed aerosol content collides to the following formed aerosol content continuously jet injected from the injection outlet into the flow passage, and the interfusion with air becomes more efficient. Thereby the foamed aerosol content becomes efficiently oxidized, and the effectiveness can be improved. Moreover, by not containing the foamed aerosol content in the aerosol container in a pre-oxidized state, and by oxidizing the foamed aerosol content by interfusing with air just before the use thereof, the quality of the foamed aerosol content can be preserved, and can be used in a very efficacious state.

Due to the foamed aerosol content jet injected into the flow passage, air is introduced into the flow passage, and therefore, the flow passage is filled with air. Therefore, the foamed aerosol content can be efficiently interfused with air and the foaming and oxidizing thereof can be attained even when the injection outlet is formed without any opening to introduce air therein except for the flow passage.

The flow passage may be connected to a push button connected to a stem of an aerosol container via a bridge member having a rectangular letter U shape and having openings at upper and lower side surfaces, wherein the outflowing outlet is formed as an opening formed at a lower side surface of the bridge member. According to the configuration, the outflowing outlet can be enlarged and the foamed aerosol content having high viscosity can be outflowed effectively.

The bridge member may be formed in an L-lettered shape and not in a rectangular letter U shape. According to the configuration, in contrast to forming the bridge member in a rectangular letter U shape, the shape of the bridge member can be simplified and lower the cost of the product. However, the configuration lowers the mechanical strength of the bridge member than that formed in a rectangular letter U shape.

Also, forming one or more of the injection outlet disposed towards the ring shaped flow passage may be preferable. When one injection outlet is disposed, the product can be easily manufactured, and the manufacturing cost of a metal mold can be reduced than that for a product having a plurality of injection outlet. By contrast, when a plurality of injection outlet is disposed, the manufacturing cost of a metal mold becomes expensive, but the efficiency of the interfusion can be improved than injecting from one injection outlet, and efficiency of oxidization and foaming of the foamed aerosol content can be improved.

The ring shaped flow passage is disposed indirection correspondent to the injection axis line of the foamed aerosol content injecting from the injection outlet. Therefore, the foamed aerosol content introduced into the flow passage performs a plurality of rotation within the ring shaped flow passage smoothly, and the time length of retention becomes long, thereby the foamed aerosol content can be efficiently interfused with air and the foaming efficiency can be improved.

As for a foamed aerosol content contained in an aerosol container, which the aerosol injection nozzle according to the invention be attached, there can be used such as body supplies (e.g. a hair supplies, cosmetic preparations, deodorants and antiperspirants), insecticides, cleaning supplies, industrial materials, car supplies and food products that becomes efficient when foamed or oxidized.

As for hair supplies, there can be used such as hair treatments, hair shampoos and hair conditioners, oxidizing hairdye, oxidizing two agent type permanent hairdye, color sprays, decolorants, permanent hair agents, hair growth tonics, hair tonics and fragrances for hair.

As for cosmetic preparations, there can be used such as after-shave lotion, fragrance, eau de colognes, facial washes, sunburn preventives, foundations, hair removers, decolorants, bathwater additives.

As for deodorants and antiperspirants, there can be used such as antiperspirants, deodorants and body shampoos. As for other body supplies, there can be used such as antiflash agents for muscle, applications for skin disorder, athlete's foot remedies, insect repellents, dry bath applications, mouth washes, toothpastes, vulneraries and applications for ambustion.

As for insecticides, there can be used such as insecticides for cockroach, gardening insecticides, insecticides for tick, disinfestants. As for cleaning supplies, there can be used such as cleaning supplies for bath, cleaning supplies for floor and furniture polishing, cleaning supplies for shoes and leathers, wax polishing agents.

As for industrial materials, there can be used such as lubricant agents, antirust agents, adhesive agents, flaw detecting agents for metal, mold lubricants and caulking agents. As for car supplies, there can be used such as antifog agents, ice melting agents and engine cleaning agents. As for other materials that can be used for the foamed aerosol content, there can be used such as supplies for animals, amusement supplies and food products (e.g. coffees, juices, creams and cheeses).

Also, the foamed aerosol content can be a type that directly filled into a normal single-layer aerosol container, or can be a type that filled into an internal container or an internal bag of a double-layer aerosol container. When in use with the double-layer aerosol container, the external container or an external bag thereof is filled with a compressed gas. It is also able to use an aerosol container having an inner compartments or a double-layer aerosol container, and to infill two different foamed aerosol content separately, and mixing the two different foamed aerosol content within the injection outlet when injected when in use.

BRIEF DESCRIPTION OF THE DRAWINGS

Accompanying the specification are figures which assist in illustrating the embodiments of the invention, in which.

DETAILED DESCRIPTION OF THE INVENTION

Figure 1:
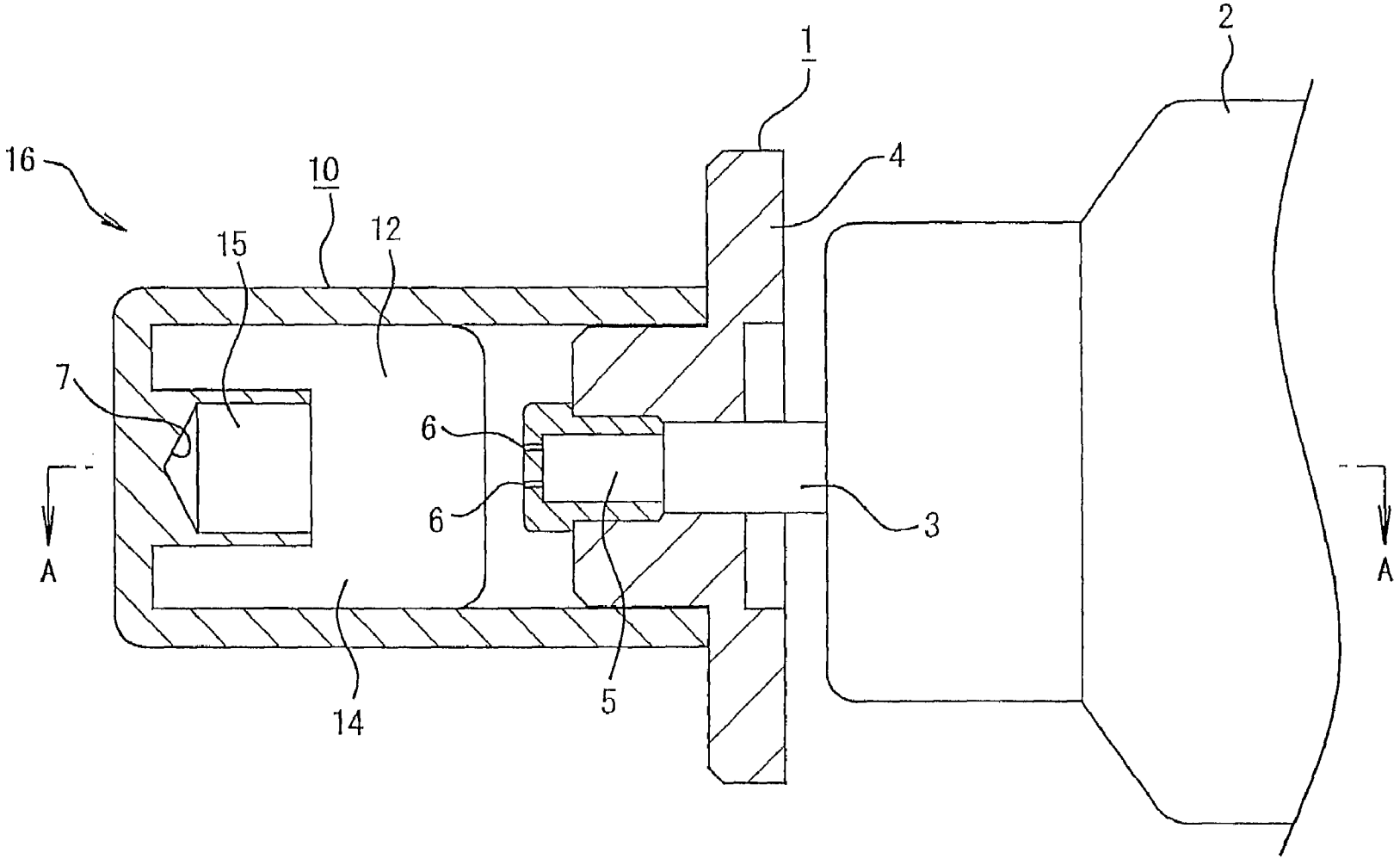
FIG. 1 is a cross sectional drawing of an injection nozzle according to a first embodiment of the invention.
Figure 2:
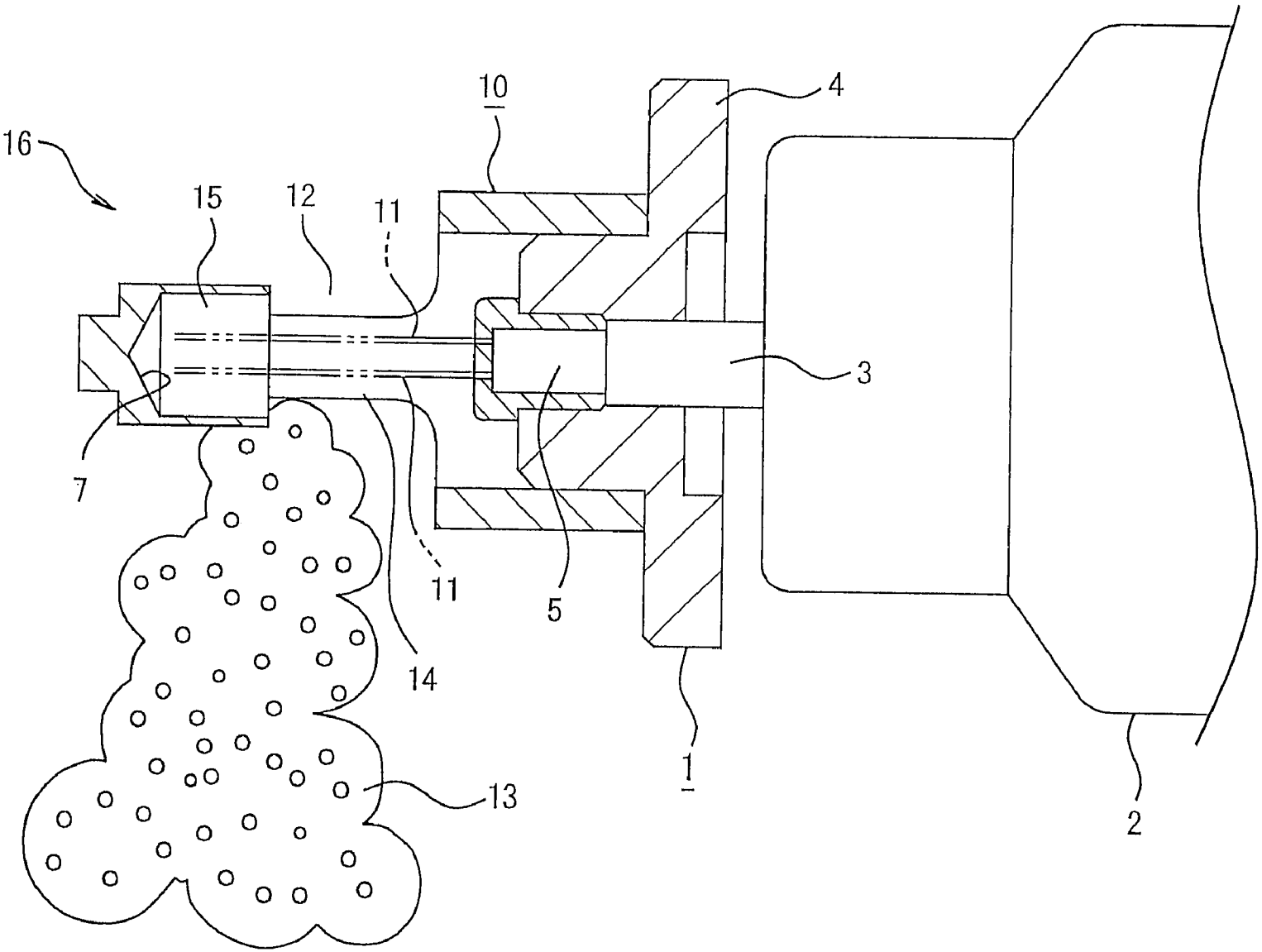
FIG. 2 is cross sectional drawing of A—A line in FIG. 1 explaining a state of injection of a foamed aerosol content.
Figure 3:
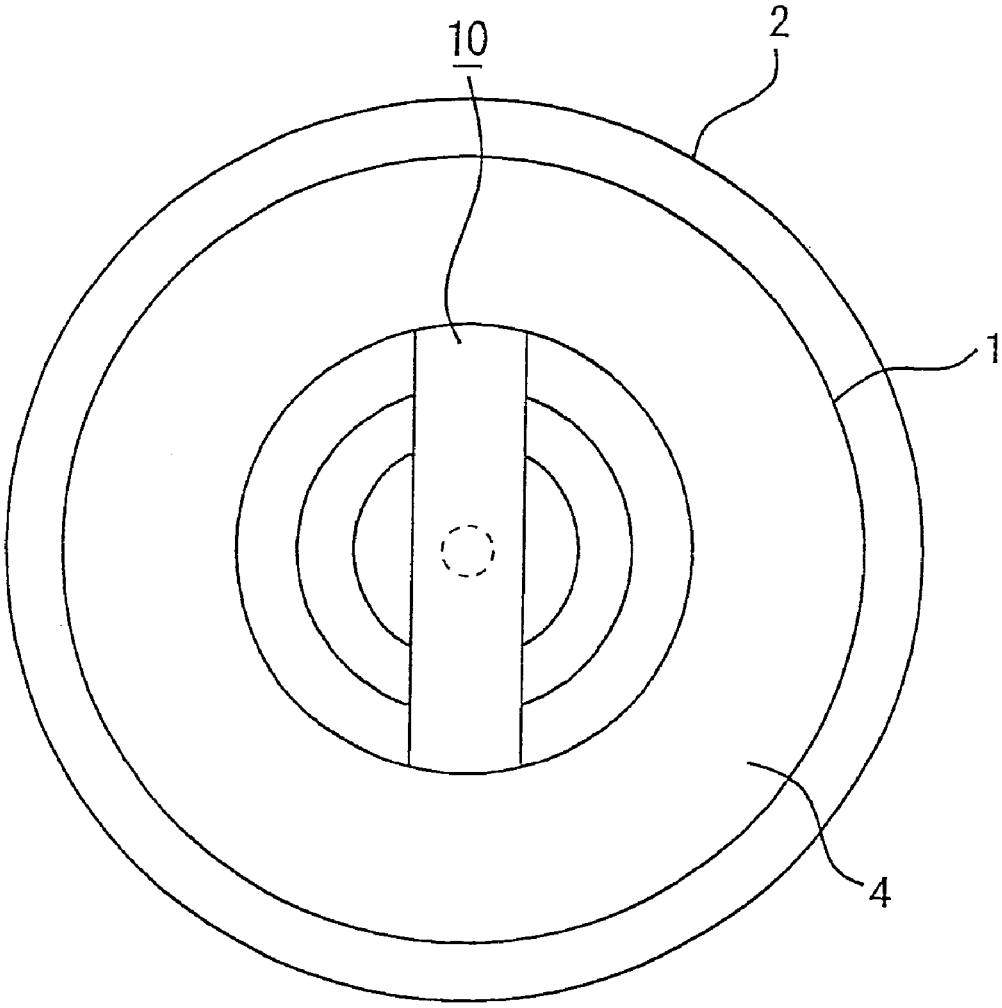
FIG. 3 is a drawing to show right side of the injection nozzle shown in FIG. 1.

Hereinafter, a first embodiment and a second embodiment according to the invention will be explained referring to FIGS. 1, 2 and 3. Numeral 1 represents a push button. The push button 1 is connected to a stem 3 of a valve mechanism (not shown) disposed on an aerosol container 2, and is disposed that the stem 3 to be pressed when the user presses the flange 4 protruded outward to the circumference of the aerosol container 2. The push button 1 has an injection passage 5 therein connected to the stem 3 and a plurality of injection outlets 6 at the leading end portion. By a plurality of injection outlets 6 being disposed, the efficiency of the interfusion of a foamed aerosol content with air can be improved than injecting from one injection outlet 6, and efficiency of oxidization and foaming of the foamed aerosol content can be improved.

A collision wall 7 for colliding the foamed aerosol content is disposed towards the injection outlets 6 and in a concave conical shape. The collision wall 7 is formed at a leading edge portion of a rectangular letter U shaped bridge member 10, which is connected to the push button 1 connected to the stem 3 of the aerosol container 2. And at least a lower side of an injection axis line 11 of the foamed aerosol content foamed between the collision wall 7 and the injection outlets 6, is being correspondent to the lower side of an opening 12, wherein the openings 12 are disposed at the upper and lower side of the bridge member 10. The opening 12 formed at a lower side surface of the bridge member 10 is used as an outflowing outlet 14.

A retention chamber 15 for temporary retaining the foamed aerosol content 13 in a foamed state is disposed at the injection outlets 6 side of the collision wall 7. The retention chamber 15 temporary retains the foamed aerosol content 13 foamed by injected from the injection outlets 6 and collided to the collision wall 7, thereby preventing the foamed aerosol content 13 from being shattered outward and attaining the foamed aerosol content 13 to be easily received by a human hand, a comb or a brush.

In aerosol injection nozzle above configured, when injecting the foamed aerosol content 13, in a state holding the aerosol container 2 by hand in a horizontal position, pressing the stem 3 of the valve mechanism (not shown) by putting a finger onto the flange 4 of the push button 1 and pressing the flange 4 towards the aerosol container 2. When the stem 3 is pressed, the aerosol container 2 and the injection outlets 6 are connected, and the foamed aerosol content 13 in the aerosol container 2 injects from a plurality of the injection outlets 6 via an injecting passage 5 of the push button 1. The injection is jet injected from a plurality of the injection outlets 6, which are formed in a minute diameter. Also, by a flowing force occurred due to the jet injection, an ejecting phenomenon occurs and external air is introduced into the retention chamber 15 from the opening 12 of the bridge member 10.

Meanwhile, the foamed aerosol content 13 jet injected from a plurality of the injection outlets 6, strongly collides to the collision wall 7 in a concaved conical shape disposed at a position where the foamed aerosol content 13 is to be injected, and bounces back in random direction and flows actively within the retention chamber 15. Due to the flowing, the foamed aerosol content 13 to be sufficiently agitated and interfused with the air within the retention chamber 15, thereby an efficient foamed aerosol content 13 containing plentiful air bubble can be attained. The foamed aerosol content 13 in the retention chamber 15 is outflowed from the outflowing outlet 14. The foamed aerosol content 13 efficiently foamed by interfusing with air is improved in adhering ability against the applying target, and therefore, the trickling of the content or shattering into the air is prevented and can be easily applied to the applying target.

The conventional invention described in JP-A-8-229463 has a problem that a foamed aerosol and dust adhered to the minute openings of the mesh screen causes a clogging. In contrast thereto, in the present invention, there is no minute opening as those of the mesh screen formed onto the injection outlets 6, and the outflowing outlet 14 for the foamed aerosol content 13 has a large diameter. Therefore, even when some foamed aerosol content 13 or dust is adhered to the outflowing outlet 14, the clogging will not occur so that the injection of the foamed aerosol content can be repeated in a good condition.

The outflowing outlet 14 is constituted as the opening 12 formed at a lower side surface of the bridge member 10, wherein at least a lower side of an injection axis line 11 of the foamed aerosol content foamed between the collision wall 7 and the injection outlets 6, is being correspondent to the lower side of an opening 12, wherein the openings 12 are disposed at the upper and lower side of the bridge member 10. Therefore, the outflowing outlet 14 of the foamed aerosol content 13 in a foamed state, can be largely formed, thereby even the foamed aerosol content 13 having a high viscosity can be assuredly outflowed without any occurrence of clogging.

The aerosol injection nozzle forms a foaming by colliding the foamed aerosol content with the collision wall 7 and interfusing with air, so that there is no need to attach an additional member such as a mesh screen, and the aerosol injection nozzle having efficient foaming effect can be manufactured in a simple constitution and in low costs.

In addition, when using a foamed aerosol content 13 that works by oxidizing such as an oxidizing hair dye, the foamed aerosol content 13 is efficiently oxidized by interfusing with air within the retention chamber 15, so that the effectiveness as an oxidizing hair dye can be improved. Moreover, by not containing the foamed aerosol content 13 in the aerosol container 2 in a pre-oxidized state, and by oxidizing the foamed aerosol content 13 by interfusing with air within the retention chamber 15 just before the use thereof, the quality of the foamed aerosol content 13 can be preserved, and can be used in a very efficacious state.

In the aforementioned first embodiment, the aerosol container 2 is held horizontally when injecting the foamed aerosol content 13.

Figure 4:
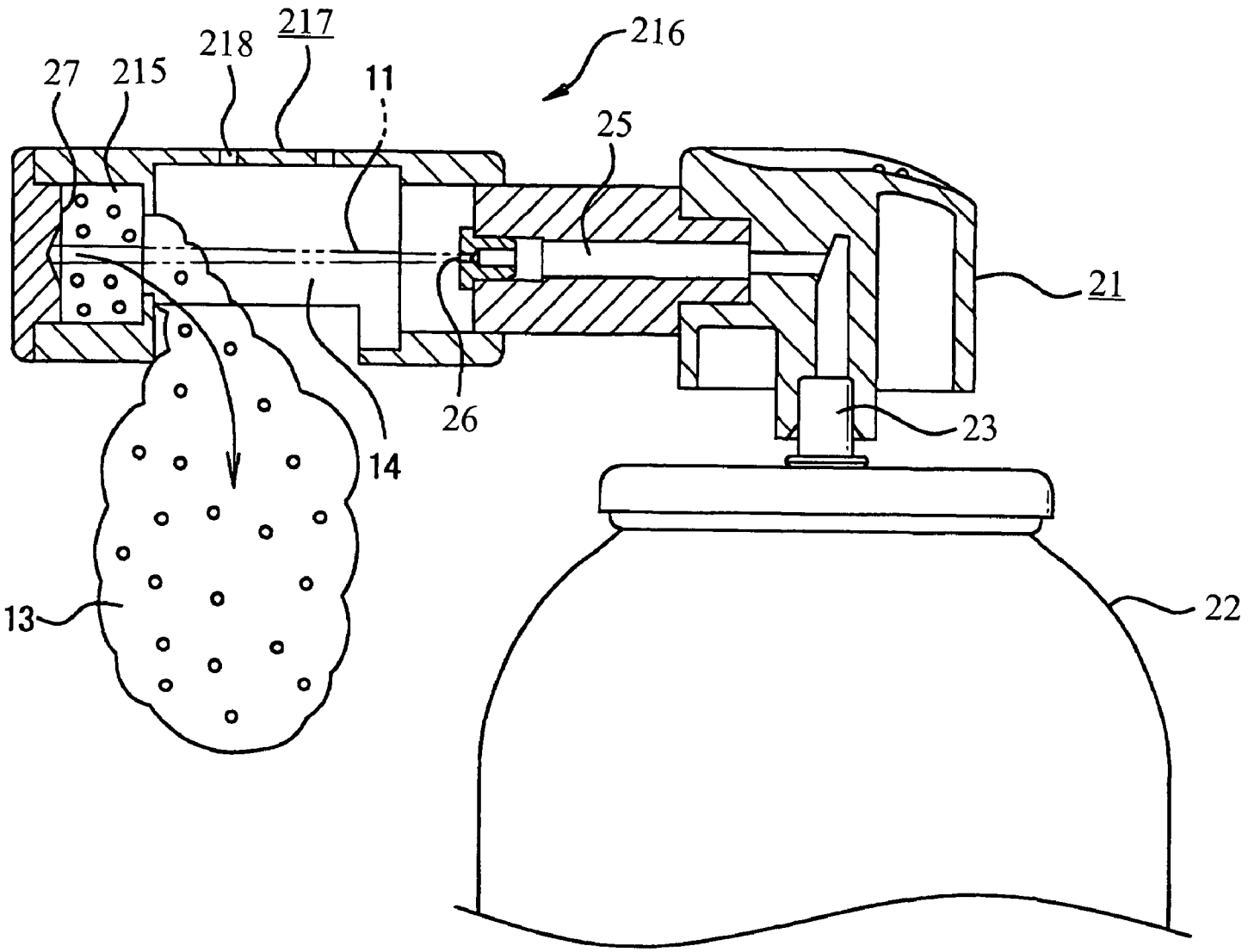
FIG. 4 is a cross sectional drawing of an injection nozzle according to a second embodiment of the invention.

An aerosol injection nozzle according to a second embodiment of the invention, as shown in FIG. 4, the aerosol container 22 is held in an erected state when injecting the foamed aerosol content 13. In the second embodiment, a nozzle member 216 is disposed and protruded from one side of the push button 21 fixed to the stem 23. The injection outlets 26 of the nozzle member 216 is formed in a manner that enables the foamed aerosol content 13 to be jet injected by forming the injection passage 25 connected to the stem 23 long with a minute diameter. The injection outlets 26 has an interfusion portion 217 disposed toward the injection outlets 26 and formed in a cylinder shape, for interfusing the foamed aerosol content 13 and air and outflowing the interfused foamed aerosol content 13.

Within the interfusion portion 217, a retention chamber 215 is disposed toward the injection outlets 26, for temporary retaining the foamed aerosol content 13, thereby the foamed aerosol content 13 can be injected within the retention chamber 15 from the injection outlets 26. The retention chamber 215 has a collision wall 7 for colliding the foamed aerosol content 13 in a concaved conical shape, which is formed by concaving the wall surface where the foamed aerosol content 13 is to be injected in a concaved conical shape.

The nozzle member 216 has an air introducing inlets 18 for introducing exterior air into the retention chamber 215, and disposed at a side of the injection inlet 6 than the collision wall 27. Each of the air introducing inlets 218, as shown in FIG. 4, are formed at two of the upper portion of the interfusion portion 217, respectively, and introduce exterior air into the retention chamber 215.

In the aforementioned second embodiment, the foamed aerosol content 13 is injected by pressing the push button 1 downwards when the aerosol container 22 is held in an erected state. The pressing of the push button 21 opens the valve mechanism via the stem 23, and the foamed aerosol content 13 is injected from the injection outlets 26 and collides to the collision wall 27 to be foamed. The other functioning of the second embodiment is same with the aforementioned first embodiment.

In the aforementioned first and second embodiment, the collision wall 27 is formed in a concaved conical shape.

Figure 5:
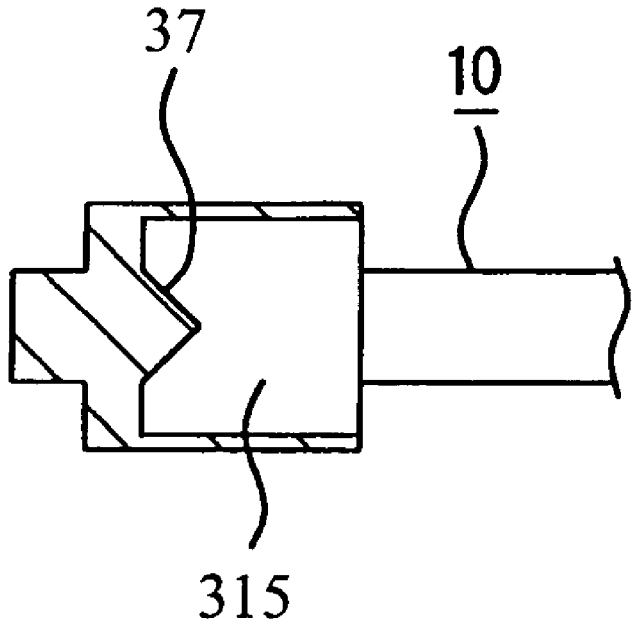
FIG. 5 is a cross sectional drawing of a collision wall part of a third embodiment of the invention.

In an aerosol injection nozzle according to a third embodiment of the invention, the collision wall 37 is formed, as shown in FIG. 5, in a protruded conical shape in direction correspondent to the injection axis line 11 of the foamed aerosol content 13 injecting from the injection outlets 6. According to the configuration, the foamed aerosol content 13 collided to the collision wall 37 rotates around the periphery of the protruded conical shape forming a vortex, and diffuses widely, thereby the time length retaining within the retention chamber 315 becomes long and efficient interfusion with air and improved foaming efficiency can be attained.

Figure 6:
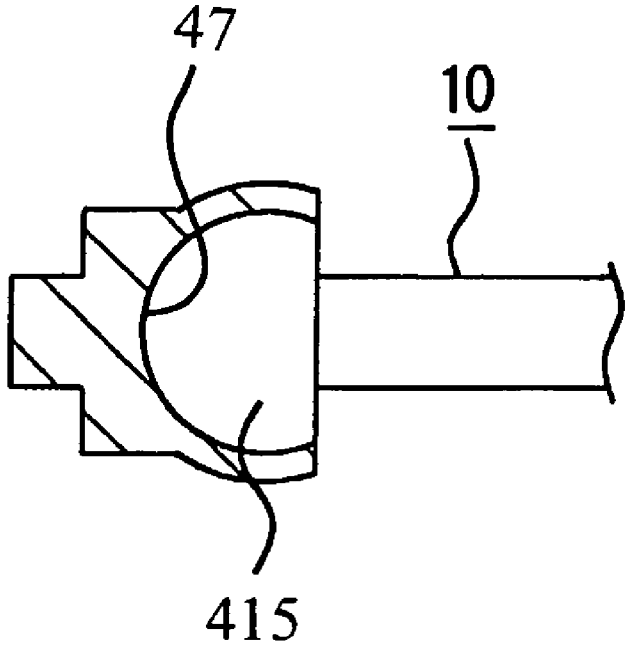
FIG. 6 is a cross sectional drawing of a collision wall part of a fourth embodiment of the invention.

In an aerosol injection nozzle according to a fourth embodiment of the invention, the collision wall 47 is formed, as shown in FIG. 6, in a concaved C-lettered shape in direction correspondent to the injection axis line 11 of the foamed aerosol content injecting from the injection outlets 6. According to the configuration, convection occurs within the concaved C-lettered shape to the foamed aerosol content 13 collided to the collision wall 47, thereby the time length retaining within the retention chamber 415 becomes long. Furthermore, the convection of the foamed aerosol content 13 collides to the following injected foamed aerosol content 13, thereby the efficient interfusion with air and improved foaming efficiency can be attained. In addition, when forming the collision wall 47 in a concaved C-lettered shape, it is possible to form only the collision wall 47 in a concaved C-lettered shape, but it is also possible to form the collision wall 47, as shown in FIG. 6, in a concaved C-lettered shape in a manner integrated with the retention chamber 415.

Figure 7:
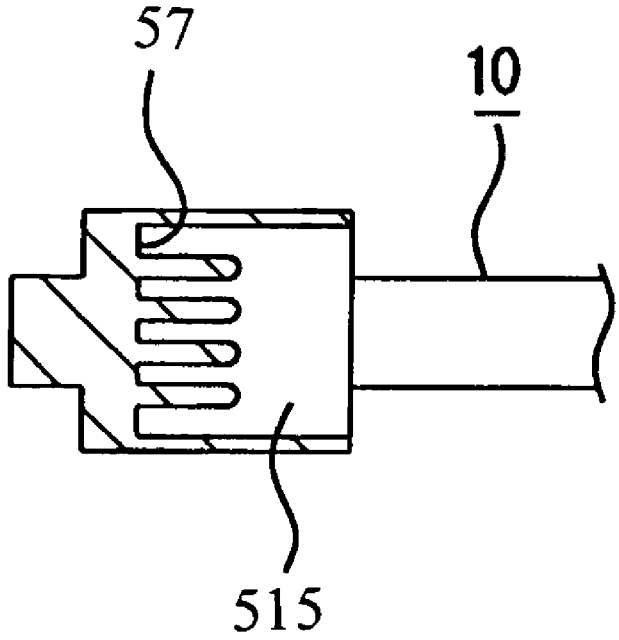
FIG. 7 is a cross sectional drawing of a collision wall part of a fifth embodiment of the invention.

In an aerosol injection nozzle according to a fifth embodiment of the invention, the collision wall 57 is formed, as shown in FIG. 7, to have a plurality of protrusion at given intervals. According to the configuration, the foamed aerosol content 13 collided into the collision wall 57 collides to the following injected foamed aerosol content 13, thereby the time length retaining within the retention chamber 515 can be made longer and efficient interfusion with air and improved foaming efficiency can be attained.

In aforementioned embodiments, the bridge member 10 is formed in a rectangular letter U shape. However, it is possible to form the bridge member 10 in an L-lettered shape instead of the rectangular letter U shape, as of an aerosol injection nozzle according to a sixth embodiment of the invention. According to the configuration, in contrast to forming the bridge member 10 in a rectangular letter U shape, the shape of the bridge member 10 can be simplified and lower the cost of the product. However, the configuration lowers the mechanical strength of the bridge member 10 than that formed in a rectangular letter U shape.

In aforementioned embodiments, a plurality of the injection outlets 6 are disposed towards the collision wall 7, thereby the efficiency of the interfusion can be improved, but the manufacturing cost of a metal mold becomes expensive when forming a plurality of injection outlets 6. By contrast, in an aerosol injection nozzle according to a seventh embodiment has only one injection outlet 6, thereby reducing the manufacturing cost of a metal mold than that for a product having a plurality of injection outlets.

Figure 9:
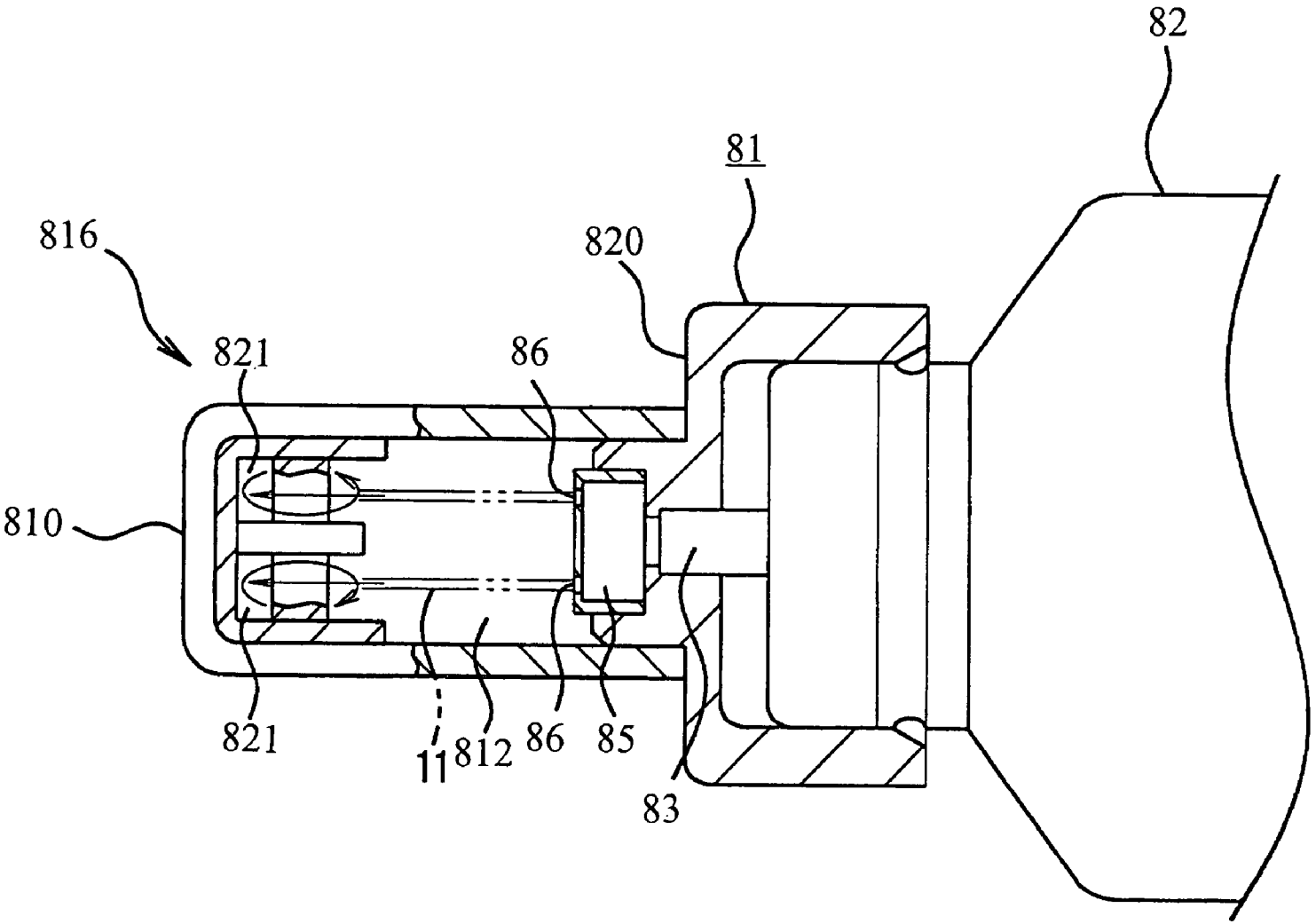
FIG. 9 is a cross sectional drawing of B—B line in FIG. 8.
Figure 10:
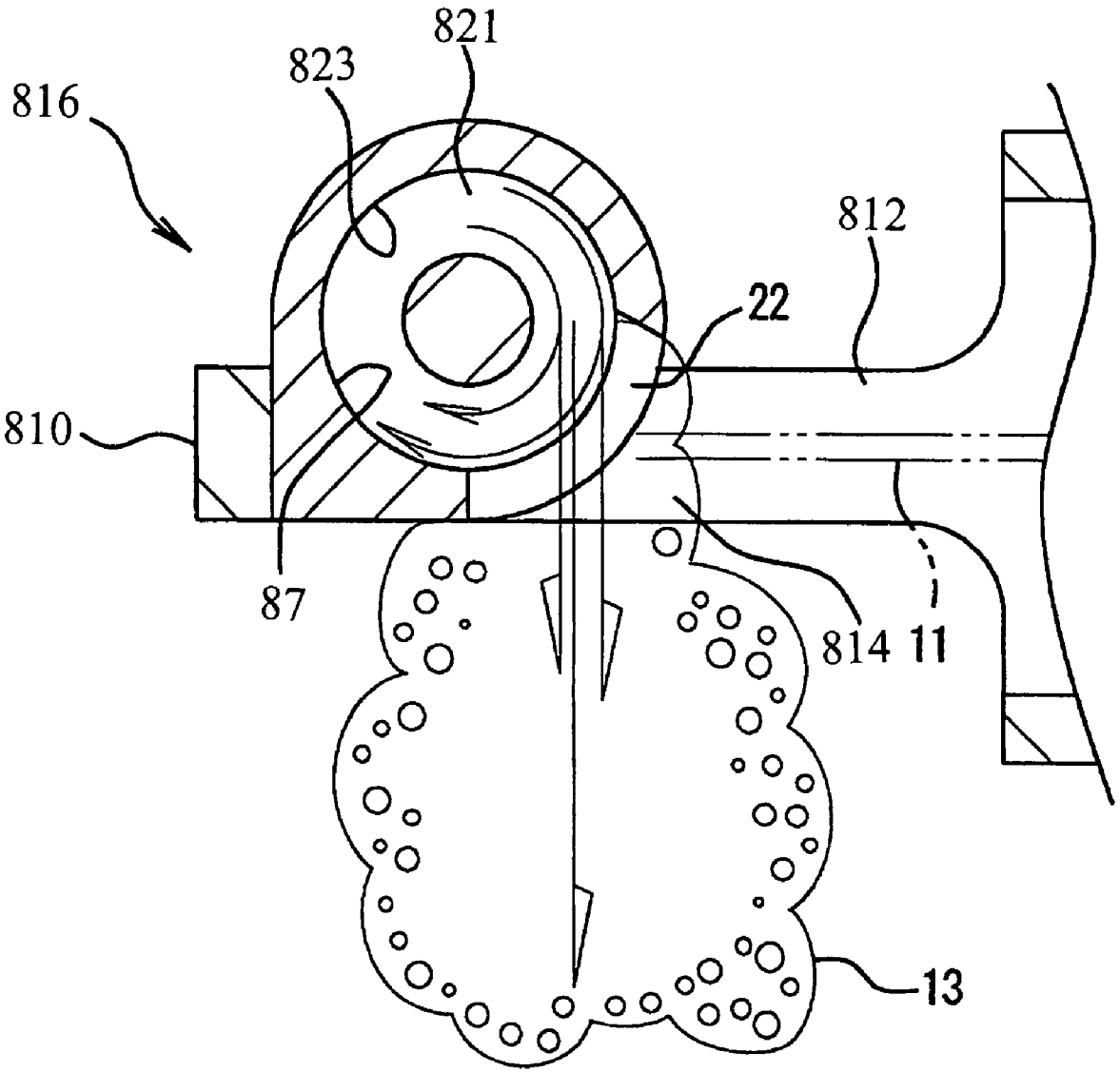
FIG. 10 is a drawing to show a partially enlarged view of a flow passage of the eighth embodiment.

Hereinafter, an aerosol injection nozzle according to an eighth embodiment of the third aspect of the invention will be explained referring to FIGS. 8, 9 and 10. The aerosol injection nozzle has a push button 81 connected to a stem 83 of a valve mechanism (not shown) disposed on an aerosol container 82, and is disposed that the stem 83 to be pressed when the user presses the stepped pressing portion 820 formed at the circumference of the push button 81. The push button 81 has an injection passage 85 therein connected to the stem 83 and a plurality of injection outlets 86 at the leading end portion. By a plurality of injection outlets 86 being disposed, the efficiency of the interfusion of a foamed aerosol content 13 with air can be improved than injecting from one injection outlets 86, and efficiency of oxidization and foaming of the foamed aerosol content can be improved.

A ring shaped flow passage 821 for colliding the foamed aerosol content 13 is disposed towards the injection outlets 86. The injection axis line 11 of the foamed aerosol content 13 is disposed in direction tangent to the ring shaped flow passage 821. The foamed aerosol content 13 injected from the injection outlets 86 collides into the collision wall 87 disposed at an inner surface 823 of the ring shaped flow passage 821. Therefore, the foamed aerosol content 13 collided to the collision wall 87 disposed at the inner surface 823 of the ring shaped flow passage 821 interfuse with air due to the collision, thereby to be foamed by rotating at least for a 360-degree within the ring shaped flow passage 821. Normally, the foamed aerosol content 13 rotates for a plurality of times to be more interfused with air and to be foamed.

The foamed aerosol content 13 in a foamed state rotates and collides to the following formed aerosol content 13 jet injected from the injection outlets 86 into the flow passage 821, and the interfusion with air becomes more efficient. Due to the foamed aerosol content 13 jet injected into the flow passage 821, air is introduced into the flow passage 821, and therefore, the flow passage 821 is filled with air. Therefore, the foamed aerosol content 13 can be assuredly foamed and the foaming and oxidizing thereof can be improved.

The flow passage 821 is formed at a leading edge portion of a rectangular letter U shaped bridge member 810, which is connected to the push button 81 connected to the stem 83 of the aerosol container 82. And at least a lower side of an injection axis line 11 of the foamed aerosol content foamed between the flow passage 821 and the injection outlets 86, is being correspondent to the lower side of an opening 812, wherein the openings 812 are disposed at the upper and lower side of the bridge member 810. The opening 812 formed at a lower side surface of the bridge member 810 is used as an outflowing outlet 814 for the foamed aerosol content 13 in a foamed state.

Figure 8:
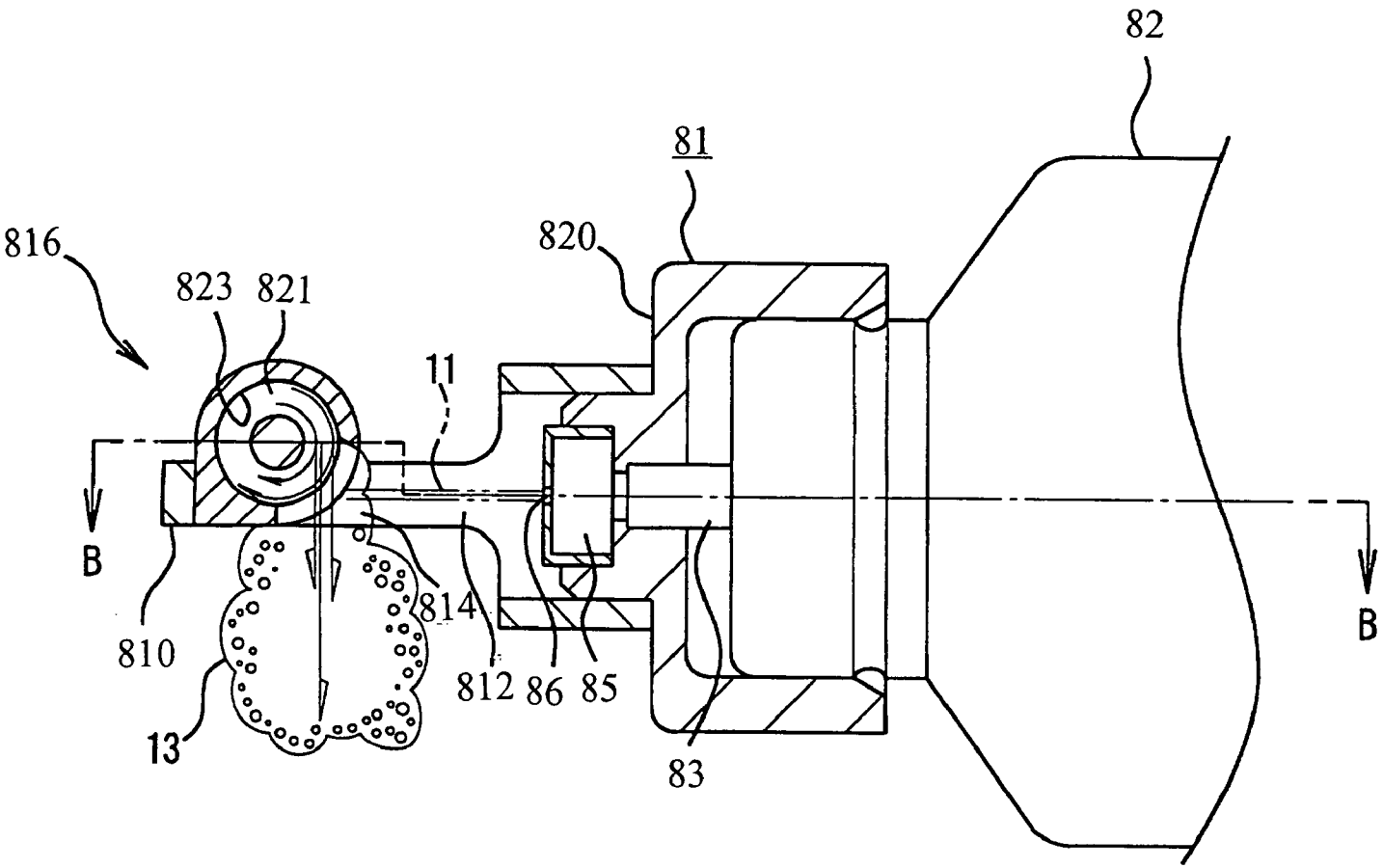
FIG. 8 is a cross sectional drawing showing a state of injection of a foamed aerosol content according to an eighth embodiment.

In aerosol injection nozzle above configured, when injecting the foamed aerosol content 13, in a state holding the aerosol container 82 by hand in a horizontal position, as shown in FIG. 8, pressing the stem 83 of the valve mechanism (not shown) by putting a finger onto the stepped pressing portion 820 of the push button 81 and pressing the stepped pressing portion 820 towards the aerosol container 82. When the stem 83 is pressed, the aerosol container 82 and the injection outlets 86 are connected, and the foamed aerosol content 13 in the aerosol container 82 injects from a plurality of the injection outlets 86 via an injecting passage 85 of the push button 81. The injection is jet injected from a plurality of the injection outlets 86, which are formed in a minute diameter. According to the introducing of the foamed aerosol content 81 into the flow passage 821, as mentioned above, the efficient foaming and oxidizing of the foamed aerosol content 13 can be attained.

The conventional invention described in JP-A-8-229463 has a problem that a foamed aerosol and dust adhered to the minute openings of the mesh screen causes a clogging. In contrast thereto, in the present invention, there is no minute openings as those of the mesh screen formed onto the injection outlets 86, and the outflowing outlet 814 for the foamed aerosol content 13 has a large diameter. Therefore, even when some foamed aerosol content 13 or a dust is adhered to the outflowing outlet 814, the clogging will not occur so that the injection of the foamed aerosol content can be repeated in good condition.

The outflowing outlet 814 is constituted as the opening 812 formed at a lower side surface of the bridge member 810, wherein at least a lower side of an injection axis line 11 of the foamed aerosol content foamed between the flow passage 821 and the injection outlets 86, is being correspondent to the lower side of an opening 812, wherein the openings 812 are disposed at the upper and lower side of the bridge member 810. Therefore, the outflowing outlet 814 of the foamed aerosol content 13 in a foamed state, can be largely formed, thereby even the foamed aerosol content 13 having a high viscosity can be assuredly outflowed without any occurrence of clogging.

The aerosol injection nozzle forms a foaming by colliding the foamed aerosol content with the collision wall 87 at the inner surface 823 of the flow passage 821 and interfusing with air, so that there is no need to attach an additional member such as a mesh screen, and the aerosol injection nozzle having efficient foaming effect can be manufactured in a simple constitution and in low cost.

In addition, when using a foamed aerosol content 13 that works by oxidizing such as an oxidizing hair dye, the foamed aerosol content 13 is efficiently oxidized by interfusing with air within the flow passage 821, so that the effectiveness as an oxidizing hair dye can be improved. Moreover, by not containing the foamed aerosol content 13 in the aerosol container 82 in a pre-oxidized state, and by oxidizing the foamed aerosol content 13 by interfusing with air within the flow passage 821 just before the use thereof, the quality of the foamed aerosol content 13 can be preserved, and can be used in a very efficacious state.

In aforementioned embodiments, the bridge member 10 is formed in a rectangular letter U shape. However, it is possible to form the bridge member 10 in an L-lettered shape instead of rectangular letter U shape, as of an aerosol injection nozzle according to another embodiment of the invention. According to the configuration, in contrast to forming the bridge member 10 in a rectangular letter U shape, the shape of the bridge member 10 can be simplified and lower the cost of the product. However, the configuration lowers the mechanical strength of the bridge member 10 than that formed in a rectangular letter U shape.

In aforementioned embodiments, a plurality of the injection outlets 6 are disposed towards the flow passage 21, thereby the efficiency of the interfusion can be improved, but the manufacturing cost of a metal mold becomes expensive when forming a plurality of injection outlets 6. By contrast, in an aerosol injection nozzle according to a seventh embodiment has only one injection outlet 6, thereby reducing the manufacturing cost of a metal mold than that for a product having a plurality of injection outlets.

An example of a hair foam as the example of the foamed aerosol content contained in the aforementioned aerosol container having the above described aerosol injection nozzle is shown below.

| Hair foam | |
|---|---|
| 95% alcohol | 10.00 wt % |
| methyl paraben | 0.10 wt % |
| reodol TW-0120 | 1.00 wt % |
| silicon BY22-007 | 0.20 wt % |
| xtanthan gum | 0.10 wt % |
| vinyl acetete vinyl pyrrolidone copolymerization | 1.00 wt % |
| vinyl pyrrolidone-N,N-dimethylamido ethyl methacrylate copolymerization diethyl hydrosulfate | 10.00 wt % |
| purified water | 77.6 wt % |
| Total | 100.00 wt % |

The above liquid concentrate is filled in an ordinary aluminum container can by pressurizing to 0.8 MPa with carbon dioxide gas.

An example of a skin-care foam as the another example of the foamed aerosol content contained in the aforementioned aerosol container having the above described aerosol injection nozzle is shown below.

| Skin-care foam | |
|---|---|
| 95% alcohol | 5.00 wt % |
| methyl paraben | 0.10 wt % |
| xtanthan gum | 0.10 wt % |
| hidroxyethyl cellulose | 0.05 wt % |
| aminocoat | 1.00 wt % |
| 1.3-butylene glycol | 3.00 wt % |
| polyoxyethylene tridecylether | 1.00 wt % |
| purified water | 89.75 wt % |
| Total | 100.00 wt % |

The above liquid concentrate is filled in internal bag of an double-layer aerosol container.

The present invention is constituted as above, and therefore, it is possible to efficiently foam a foamed aerosol content, and to form an outflowing outlet of the foamed aerosol in a large diameter in contrast to an constitution that disposing the outflowing outlet in injecting direction or in the vicinity of the injection outlet, thereby preventing a clogging of the outflowing outlet even when a foamed aerosol content is used, and repeatedly able to inject the foamed aerosol content.

In addition, in the third aspect of the invention, the foamed aerosol jet injected from the injection outlet strongly collides to a collision wall of an inner surface of a flow passage and flows at high speed within the flow passage formed in ring shape, thereby improve the foaming of the foamed aerosol content.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

The invention claimed is:

1. An aerosol injection nozzle comprising:

at least one injection outlet injecting an aerosol flow;

a flow passage including first and second ends and an intermediate section;

said first end including a collision wall for receiving said aerosol flow from at least one said injection outlet and directing said flow into said intermediate section;

said intermediate section directing said flow towards said second end;

said second end including an outflow outlet for dispensing said aerosol flow; and said outflow outlet being disposed intermediate of said collision wall and said injection outlet.

2. The aerosol injection nozzle according to claim 1, wherein said nozzle further comprises:

a bridge member, said bridge member being U shaped, said bridge member including upper and lower side surfaces, said upper and lower side surfaces including at least one opening, said lower surface opening defining said outflow outlet;

said bridge member including first and second ends, said first end including of said bridge member a push button, said push button engaging a stem of an aerosol container; and said second end of said bridge member including said collision wall.

3. The aerosol injection nozzle according to claim 1, wherein said at least one injection outlet axially injects said aerosol flow towards said collision wall.

4. An aerosol injection nozzle comprising:

at least one injection outlet axially injecting an aerosol flow;

a ring shaped flow passage including first and second ends and an intermediate section;

said first end including a collision wall for receiving said aerosol flow from said at least one injection outlet and directing said flow into said intermediate section;

said intermediate section rotating said aerosol flow at least 360 degrees and directing said flow towards said second end;

said second end being a lower surface and including an outflow outlet for dispensing said aerosol flow; and said outflow outlet being disposed intermediate of said collision wall and said injection outlet.

5. The aerosol injection nozzle according to claim 4, wherein said nozzle further comprises:

a bridge member, said bridge member being U shaped, said bridge member including upper and lower side surfaces, said upper and lower side surfaces including at least one opening, said lower surface opening defining said outflow outlet;

said bridge member including first and second ends, said first end of said bridge member including a push button, said push button engaging a stem of an aerosol container; and said second end of said bridge member including said ring shaped flow passage.

6. The aerosol injection nozzle according to claim 4, wherein said at least one injection outlet axially injects said aerosol flow towards said collision wall.

* * * * *